United States Patent [19]

Ostkamp et al.

[11] 4,313,559

[45] Feb. 2, 1982

[54] FULLY JACKETED HELICAL CENTRIFUGE

[75] Inventors: Willi Ostkamp, Oelde; Theodor Paschedag, Beckum, both of Fed. Rep. of Germany

[73] Assignee: Westfalia Separator AG, Oelde, Fed. Rep. of Germany

[21] Appl. No.: 112,685

[22] Filed: Jan. 16, 1980

[30] Foreign Application Priority Data

Jan. 17, 1979 [DE] Fed. Rep. of Germany ..... 2901607

[51] Int. Cl.[3] ..... B04B 3/04

[52] U.S. Cl. ..... 233/7; 233/47 R

[58] Field of Search ..... 233/7, 6, 8, 12, 19 R, 233/19 A, 20 R, 20 A, 46, 47 R, 47 A

[56] References Cited

U.S. PATENT DOCUMENTS

| | | | |
|---|---|---|---|
| 3,623,656 | 11/1971 | Lavanchy | 233/7 |
| 3,784,091 | 1/1974 | Hiller | 233/7 |
| 3,885,734 | 5/1975 | Lee | 233/7 |
| 3,955,756 | 5/1976 | Hiller | 233/7 |

*Primary Examiner*—Robert W. Jenkins

*Attorney, Agent, or Firm*—Sprung, Felfe, Horn, Lynch & Kramer

[57] ABSTRACT

Centrifuge for separation of a mixture of solid particles, a specifically heavier liquid, and a specifically lighter liquid into the three component parts, having a conveyor helix 3 for moving the solid particles to one end of the drum 1, and, at the other end of the drum, a paring system, i.e. a centripetal pump 18, for removing one of the liquids under pressure and a catchment 24 for the removal of the other liquid without pressure. In order to permit removal of either the heavier phase (FIG. 1) or the lighter phase (FIG. 2) by the paring system a separating disk 6, 7 is disposed adjacent each end of the drum. The separator disks project radially outwardly from the helix and extend through the lighter liquid and partially through the heavier liquid. Each disk is provided with a closable opening at the level of the zone of separation. A weir for the overflow of liquid to go to the catchment 24 is provided by a conduit 21 having an open end disposed adjacent the solids discharge end of the drum. In operation, the opening in one of the separating disks is closed while the other is left open, and, depending on which disk has the closed opening, the heavier liquid or the lighter liquid goes to the paring system. The weir 20 of the paring system is replaceable.

5 Claims, 3 Drawing Figures

FULLY JACKETED HELICAL CENTRIFUGE

BACKGROUND

The invention relates to a fully jacketed helical centrifuge for the separation of a mixture of solids and liquids, having an at least partially conical drum which can be driven in rotation, and a conveyor helix which can be driven for rotation within the drum at a differential rotatory speed, whose spirals are adapted in shape to the internal wall of the drum and convey the solid matter settling in the separating chamber formed between the nave of the helix and the drum to a solids outlet formed in the conically tapering end portion of the drum, and having a paring system in a chamber which is provided in the drum end portion opposite the solids outlet end for the removal of a first liquid phase, and a discharge chamber for a second liquid phase, which is defined in relation to the separating chamber by a weir, closed off from the input chamber, and provided in the end cover of the drum, and at least one separating disk partially immersed in the specifically heavier liquid phase and constructed in the form of a termination of the helix.

A fully jacketed helical centrifuge of this kind is known through GB Pat. No. 1,518,680 and operates as a so-called three-phase decanter in which the specifically heavier liquid phase can be taken out under pressure by a paring system and the specifically lighter liquid phase is discharged without pressure over a weir into a receiving chamber of the centrifuge housing.

However, fully jacketed helical centrifuges are also known which remove the specifically lighter liquid phase under pressure by means of a paring system, and discharge the specifically heavier liquid phase under no pressure.

Fully jacketed helical centrifuges, in which the two liquid phases can be ejected under pressure by means of paring systems, present considerable design difficulties, because the liquids have to be transferred from one revolving centrifugal part into another which revolves at a different speed. Therefore, fully jacketed helical centrifuges are used mostly with a paring system for the removal of one of the liquid phases under pressure, while the second liquid phase is removed without pressure, for example over an adjustable weir.

Fully jacketed helical centrifuges of this kind are used in many ways in the chemical and pharmaceutical industry, and for a great variety of purposes, and often one liquid phase may consist of an aqueous liquid and the other of a solvent such as acetate, benzene, chloroform or the like. Since such solvents are very volatile by nature, they are inclined to evaporate rapidly. In addition, they are often toxic or explosive and cause severe harm to the health of the personnel serving the centrifuges unless appropriate protective measures are taken. For these reasons it is necessary to remove at least the solvent phase from the centrifuge under pressure and not to let it leave the centrifuge at atmospheric pressure, which would always involve increased evaporation.

Since on the other hand such solvents may be either lighter or heavier in specific gravity than the aqueous phase, different centrifuge designs must be used, or, in the event of a product changeover, a considerable replacement of parts of the centrifuge is necessary if the solvent phase is in all cases to be removed under pressure. This is especially true when such centrifuges are used in washing or extraction processes.

THE INVENTION

It is the object of the present invention to construct fully jacketed centrifuges of the above-described type such that simple measures will suffice to adapt the centrifuge so that the specifically heavy or specifically light liquid phase can be removed by means of a paring system, while the other liquid case is removed without pressure.

This object is achieved in accordance with the invention by disposing at each end of the conveyor helix a separating disk partially immersed in the specifically heavier liquid phase, providing in the separating disks one or more closable apertures within the zone of separation of the liquid mixture, and equipping the chamber of the paring system with an adjustable weir.

The provision, in accordance with the invention, of the closable apertures in the area of the zone of separation of the liquid mixture in the separating disks partially immersed in the specifically heavier liquid at the ends of the conveyor helix brings it about that the flow of the liquids in the centrifuge can be controlled by closing the apertures in the one or the other separating disk such that the specifically heavier or the specifically lighter liquid phase is removed under pressure by the paring system, and the other liquid phase is removed without pressure. All that need be done is to replace an interchangeable weir in the paring system chamber, according to the difference in the density of the liquid phases that are to be separated. Advantageously, the apertures in the separating disks are closed with threaded plugs.

The centrifuge can thus be adapted with a few parts and with little effort to the particular conditions of operation.

The centrifuge of the invention will now be explained further with the aid of an example.

In the appended drawing.

Figure 1:
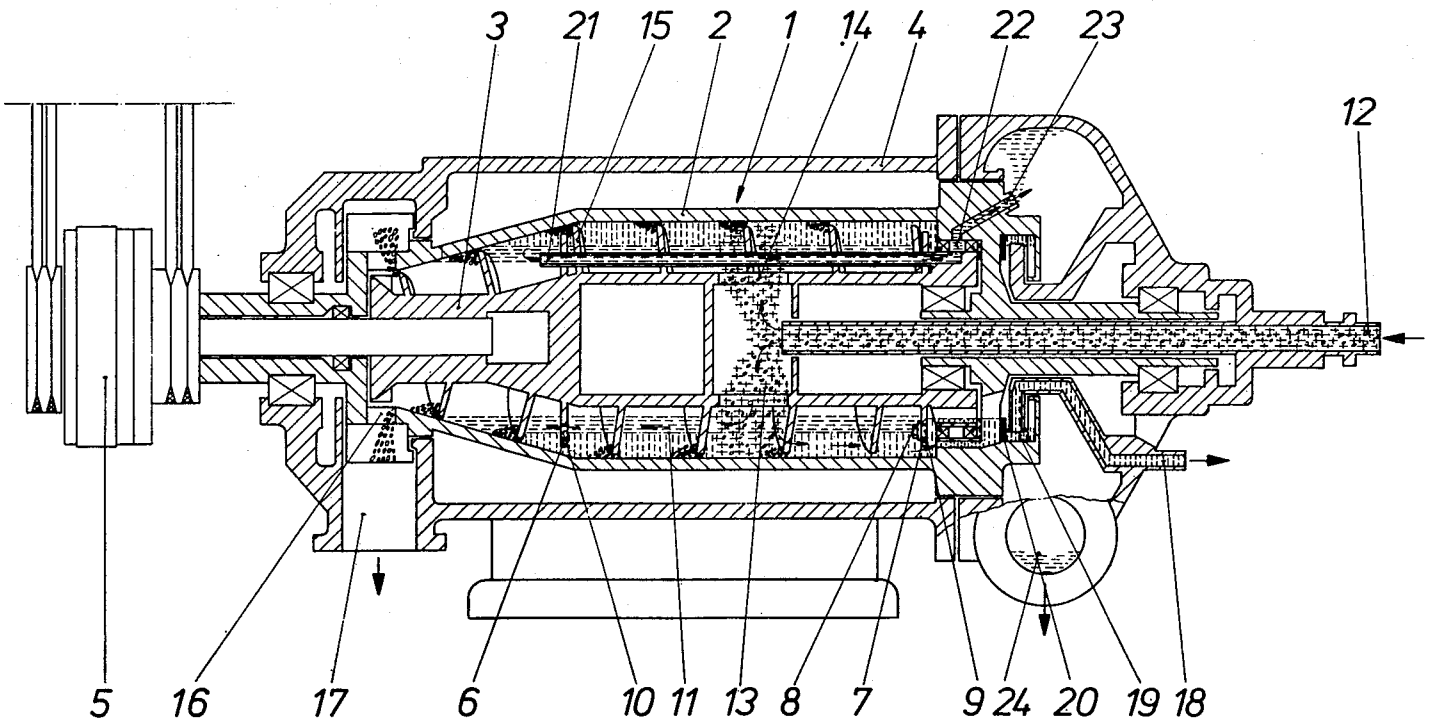
FIG. 1 is a diagrammatic representation of a fully jacketed helical centrifuge of the kind described in the beginning for the separation of a mixture of liquids and solids, in which the specifically heavy liquid is removed by means of a paring system.

FIG. 1 shows a fully jacketed helical centrifuge in the form of a three-phase decanter for the separation of mixtures of liquids and solids, having a rotatably mounted drum 1 of cylindro-conical shape having a conveyor helix 3 conforming to the drum periphery 2, and a stationary housing 4. By means of an epicyclic gear train 5, the differential rotatory speed required between the drum periphery and the conveyor helix is produced in a known manner. In accordance with the invention, one separating disk 6 and 7 reaching close to the drum periphery and partially immersed in the specifically heavier liquid phase is provided at each end of the conveyor helix, in which the apertures 9 and 10 are provided at the level of the zone of separation 11 of the liquid mixture, these apertures being closable by means of plugs 8. The liquid mixture containing solids is fed in through the pipe 12 into the chamber 13, and from there through openings 14 to within reach of the spirals 15 of the conveyor helix where the separation of the mixture of solids and liquids takes place. While the solids are conveyed by the spirals of the conveyor helix towards the conical end of the drum and are ejected through discharge openings 16 and 17 in the drum periphery and housing, the specifically heavy liquid phase is removed by means of a paring system 18 disposed in a chamber 19 which is defined on the helix side by a replaceable overflow weir 20.

The removal of the specifically light liquid phase which has been separated in the conveyor helix area takes place through one or more tubes 21 which serve as a stationary overflow means (and constitute a second overflow weir(s)) disposed within the spirals, parallel to the drum axis, and which conduct the liquid into a chamber 22 sealingly disposed between the drum periphery and the conveyor helix, from which it is discharged without pressure through passages 23 in the catchment 24 of the centrifuge housing.

By means of the stoppered apertures 9 in the separating disk 7 partially immersed in the specifically heavy liquid, the specifically lighter phase is prevented from getting into the chamber 19 where it might become mixed with the specifically heavy phase that is entering and leaving it.

Figure 2:
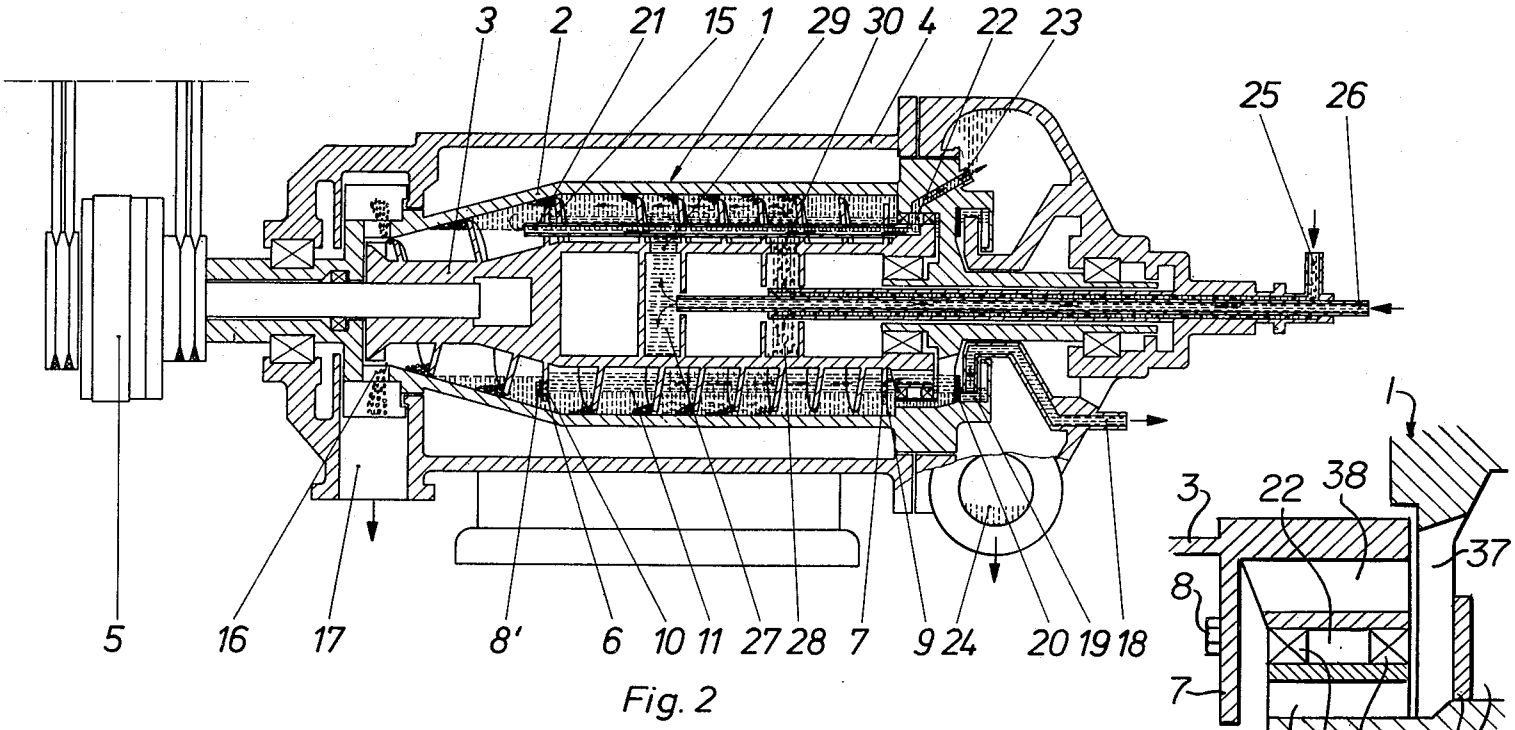
FIG. 2 is a diagrammatic representation of a fully jacketed helical centrifuge of the kind described above, which is a washing or extracting centrifuge, in which the specifically light liquid phase is removed by means of a paring device.

FIG. 2 shows the principle of an identical fully jacketed helical centrifuge, but this one is designed as a washing centrifuge or a counterflow extraction centrifuge, and the specifically light liquid phase is carried out under pressure by means of a paring system 18. For this purpose the two liquids, one of which contains the solids, are introduced through separate lines 25 and 26 into the separate chambers 27 and 28, and are carried through openings 29 and 30 into the area of the spirals 15 of the conveyor helix 3 and flow in opposite directions through the conveyor helix.

In this arrangement of the centrifuge, however, the apertures 10 in the separating disk 6 are provided with plugs 8', while the apertures 9 in separating disk 7 are open. In this arrangement, the specifically lighter liquid phase flows through the apertures 9 in separating disk 7 across the weir 20 and into the chamber 19, from which it is pumped out of the centrifuge under pressure by means of the paring system 18. The specifically heavier liquid flows over the separating disk 6 through the tubes 21 into the chamber 22 from which it is removed through passage 23 to the catchment 24 under no pressure.

The choice of the inside diameter of the replaceable weir 20 depends on the difference in the density of the liquids being separated.

To clarify the flow of the liquids, the different liquids have been represented by different shading.

Figure 3:
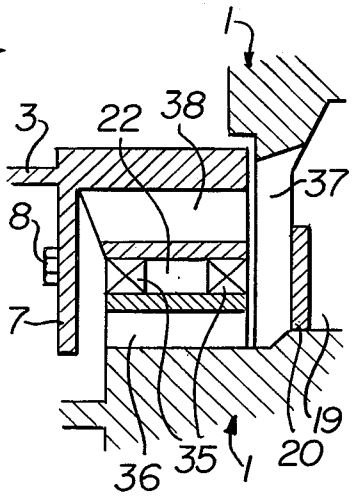
FIG. 3 is an enlargement of part of FIG. 1.

A detail of the construction in the area of the separating disk 7 and the paring chamber 19 for the embodiment of FIG. 1 is shown in FIG. 3.

The seals 35 together with the adjacent parts of the drum 1 and conveyor helix 3, define the chamber 22 which is a ring chamber coaxial with the conveyor helix. One or more passages 36 in the drum 1 and one or more cut outs 37 in the drum 1 permit the heavy phase to travel to, and overflow the weir 20 when the aperture 9 is closed (FIG. 1). For the alternative operation, i.e. where the light phase is to overflow the weir and the aperture 9 is open while the aperture 10 is closed (FIG. 2), one or more passages 38 are provided to permit travel of the light phase to the weir for overflowing into chamber 19. In the embodiment of FIG. 1, the passages or bores 38 are not operative while in the embodiment of FIG. 2, the passages 36 are not operative.

Whereas in FIG. 1 and FIG. 2 there are differences in the interior construction of conveyor helix, it will be understood by those skilled in the art that the internal construction could be identical and the centrifuge could then be used in different services such that in one the heavy phase could be removed under pressure while the light phase is not removed under pressure, and in the other light phase could be removed under pressure while the heavy phase is not removed under pressure.

For instance the conveyor helix of FIG. 2 could be used for an operation as is depicted in FIG. 1 by merely introducing the feed mixture by way of the conduit 25 while flow to conduit 26 is shut off.

While in the foregoing it is said that whereas one liquid is removed under pressure and the other is removed without pressure, it will be appreciated that the entire operation is carried out under elevated pressure so that both liquids would be removed under pressure with the one removed via the paring system being under a higher pressure. Thus the invention contemplates that the pressure of the liquid in the catchment 24 can be substantially equal to the pressure over the liquids in the drum.

What is claimed is:

1. Helical centrifuge suitable for the separation of a mixture of a specifically heavier liquid, a specifically lighter liquid and solid particles, having an at least partially conical drum which can be driven rotationally, and a conveyor helix which can be driven rotationally at a different speed disposed coaxially within the drum, the drum and the helix defining a separating chamber for the separation, the spirals of the helix being constructed to conform to the inner wall of the drum with a corresponding conical section for driving the solid particles settling under centrifugal force in the separating chamber to one end of the drum, means defining a solids discharge opening at said one end of the drum for receiving the separated solid particles from the conveyor helix, a paring system disposed at the other end of the drum for removal of one of said liquids comprising a receiving chamber and a first overflow weir and means communicating the separating chamber with the paring system for removal of said one of said liquids by the paring system, a catchment for the other of said liquids disposed at said other end of the drum, a second overflow weir for receiving the second liquid from the separating chamber and means communicating the second overflow weir with the catchment, means sealing the catchment from the receiving chamber of the paring system, the improvement which comprises a separating disk adjacent each end of the conveyor helix for projecting through the specifically lighter liquid and partially through the specifically heavier liquid, at least one closable aperture in each separator disk for disposition at the zone of separation of the specifically heavier liquid and the specifically lighter liquid, the paring system overflow weir being replacable.

2. Centrifuge of claim 1, wherein the aperture in one of the separation disks is closed.

3. Centrifuge of claim 1 or 2, and a first conduit projecting through the spirals of the conveyor helix and having an open end portion disposed adjacent said one end of the drum, the other end of the conduit being disposed adjacent said other end of the drum and communicating with a liquid discharge chamber disposed between the conveyor helix and the drum and defined in part by said sealing means, and a second conduit communicating the liquid discharge chamber with the catchment, said second overflow weir comprising the first conduit open end portion, and said means communicating the second overflow weir with the catchment comprising the balance of the first conduit, the liquid discharge chamber, and the second conduit.

4. Centrifuge of claim 3, wherein the means communicating the second overflow weir with the catchment is such that the pressure of the liquid in the catchment is substantially equal to the pressure over the liquids in the drum.

5. Centrifuge of claim 1 or 2, wherein the means communicating the second overflow weir with the catchment is such that the pressure of the liquid in the catchment is substantially equal to the pressure over the liquids in the drum.

* * * * *